US006039649A

United States Patent [19]

Schulze

[11] Patent Number: 6,039,649

[45] Date of Patent: Mar. 21, 2000

[54] MONEY-OPERATED ENTERTAINMENT MACHINE

[75] Inventor: Ullrich Schulze, Wiesbaden, Germany

[73] Assignee: NSM Aktiengesellschaft, Bingen, Germany

[21] Appl. No.: 08/875,578

[22] PCT Filed: Nov. 3, 1995

[86] PCT No.: PCT/DE95/01547

§ 371 Date: Jul. 24, 1997

§ 102(e) Date: Jul. 24, 1997

[87] PCT Pub. No.: WO96/23287

PCT Pub. Date: Aug. 1, 1996

[30] Foreign Application Priority Data

Jan. 24, 1995 [DE] Germany ..... 195 01 955
Sep. 9, 1995 [DE] Germany ..... 195 33 417

[51] Int. Cl.[7] ..... A63F 9/24

[52] U.S. Cl. ..... 463/16; 273/138.2; 463/25

[58] Field of Search ..... 273/138.2, 138.1, 273/138 A, 143 R; 463/20, 16, 25

[56] References Cited

FOREIGN PATENT DOCUMENTS

| | | | |
|---|---|---|---|
| 3444148 | 6/1986 | Germany . | |
| 3801643 | 7/1989 | Germany . | |
| 4010932 | 10/1991 | Germany | 273/138.2 |
| 4134229 | 4/1993 | Germany . | |
| 4201555 | 7/1993 | Germany | 273/138 A |
| 2083936 | 3/1982 | United Kingdom | 273/138.2 |
| 2210191 | 6/1989 | United Kingdom . | |

*Primary Examiner*—Benjamin H. Layno
*Attorney, Agent, or Firm*—Venable; George H. Spencer; Catherine M. Voorhees

[57] ABSTRACT

A money-operated entertainment machine is provided with a game device including a plurality of display components (5) which are illuminated according to specific payoffs. The entertainment machine is further provided with a computer-controlled unit for controlling the course of the game. In order to render the game interesting for spectators, the game device takes the form of a risk game device (1) which increases the stake or a portion or multiple thereof when there is a risk of losing. The risk game device (1) includes a risk —display column (3) which is placed on a stand (2) and includes a display scale (4) which is composed of superimposed display components (5).

19 Claims, 2 Drawing Sheets

MONEY-OPERATED ENTERTAINMENT MACHINE

BACKGROUND OF THE INVENTION

A money-operated entertainment machine has a game device comprising a plurality of display elements that indicate individual wins and can be illuminated, and a computer-controlled control unit for controlling the course of the game.

Entertainment machines of this type are known in widely-varying embodiments. For example, DE 36 38 100 A1 discloses a coin-operated, roulette-type game machine that indicates a win. The machine has a roulette wheel comprising number fields, on which a spinning ball can be simulated as a point of light, and a table provided with key fields representing the numbers of the roulette wheel for selecting a winning number or group of winning numbers. Associated with the individual number fields are lamps that illuminate the number fields, in the form of a point of light, consecutively in the circumferential direction during the indication of a win to simulate the action of a roulette game. When the illumination of the roulette table ceases, as dictated by chance, one number field is illuminated, resulting in a win in the event that the number coincides with the associated, selected key field of the table.

Game machines provided with a symbol game device are also known; these typically have three rotating bodies configured as rollers, disks or flip-card carousels. On the top side, which is visible from the outside through viewing windows, the rotating bodies are provided with symbols. The rotating bodies are stopped consecutively and, after all of the bodies have come to a stop, the symbol combination displayed in the viewing windows indicates a win or loss. Instead of rotating bodies, light fields provided with symbols can also be used, with a rotating light point being associated with each field. In this case, the light fields marked by the light points at the end of the game determine a win or loss.

Moreover, known entertainment machines that have a symbol game device frequently have a risk game device configured as an additional-win game device, which can be actuated by keystrokes or computer control when a win has already been attained in the symbol game device. A risk scale whose display elements indicate different winning values visually highlights the attained win and the attainable win. A chance generator provided in the entertainment machine determines whether the win that has already been attained will be lost or increased. If the win is increased, it is displayed again as an attained win, and the win that can now be attained is visually highlighted again. If the chance generator decides that the win will be lost, a total-loss display element associated with the risk scale is illuminated, and a new game can begin.

SUMMARY OF THE INVENTION

It is the object of the invention to make the game action more interesting in a game machine of the type mentioned at the outset, thus increasing the player's entertainment and the appeal of the game through a greater variety of the game action.

In accordance with the invention, this object is accomplished in that the game device is configured as a risk game device that increases a monetary amount, or a portion or multiple thereof, when the risk of a loss exists.

This measure makes the game action considerably more interesting, because the player now has the option of increasing a current monetary amount directly, step-by-step, when a monetary amount or an already-attained win is at risk of loss. The player is therefore no longer instructed in entering the risk game through the attainment of certain symbol combinations in the symbol game device, as in the known entertainment machines. The events occurring in the risk game that begins immediately after the actuation of the monetary amount make the game tremendously appealing, and continuously increase the player's tension. The result is a fast-paced, exciting game that provides high-quality entertainment and variable chances of winning. If a portion or a multiple of the monetary amount is played, the potential win is correspondingly decreased or increased.

In accordance with an advantageous embodiment of the invention, the risk game device includes a risk-display column supported on a stand housing and comprising a display scale composed of display elements arranged one on top of the other. This allows, on the one hand, a simple relocation of the entertainment machine and, on the other hand, a visually prominent representation of the risk game device.

So that the course of the game can be watched from numerous viewing angles, in accordance with a modification of the invention, each display element of the risk-display column is subdivided into at least two display segments that represent the same win value and are spatially offset from one another. The display elements of the risk-display column are advisably circular or polygonal. With a corresponding configuration of the display segments of the individual display elements, this permits all-around viewing of the risk-display column, allowing a relatively large number of spectators to follow the action along with the player.

In a further, attractive embodiment of the entertainment machine, the lowermost display element of the risk-display column represents a total loss, and the display elements above it represent wins in ascending order.

Thus, the representation of the display elements familiar to the player from the known entertainment machines having a symbol game device and risk game device is retained, leading to quick acceptance of the entertainment machine.

To highlight the attained win, a further modification of the solution of the invention provides a display field at the upper end of the risk-display column, in which the attained win of the respective level can be additionally represented inside the risk-display column. This display field is preferably subdivided into at least two display segments representing the same win value and disposed offset from one another. This permits the attained win to be viewed from numerous vantage points.

For the purpose of broadening the variation spectrum of win options, according to a further embodiment of the invention, the display elements of the risk-display column are configured to display different values. Consequently, the proprietor of the entertainment machine can adapt the risk game device to the changing requirements of different locations of operation simply by reconfiguring the represented values of the display elements of the risk-display column. Thus, the type of win displayed on the display elements (monetary wins, special game wins, in which a win key is used for increased chances of winning—for example every attained win is doubled, free game wins, point wins and the like) and the magnitude of the win can be changed quickly; a partial transfer of winnings can also be provided.

The game is usefully initiated by the actuation of a manual start lever if a sufficient monetary amount is represented in a credit display. As an alternative, the game can also be initiated with computer control through the actuation of a key.

To give the player a relatively large amount of leeway in choosing his monetary amount, thus meeting the initial condition for the risk game, in an advantageous embodiment of the invention, a key for step-wise selection of the magnitude of the monetary amount in the risk-display column is associated with the credit display. The player can therefore determine the level of entrance into the risk-display column corresponding to his credit. The player can thus select the monetary amount, and thereby determine the magnitude of the attainable win.

To allow the player to influence the game action, according to a modification of the invention, a risk key is associated with the risk-display column. When this key is actuated, either the higher win is attained or the played monetary amount or win is lost. Moreover, it is preferably provided that a payoff key is associated with the risk-display column; when this key is actuated, the risk game is terminated, and the attained win is paid out.

At least one loudspeaker is preferably disposed inside the stand housing. The loudspeaker serves in providing acoustic information and animation, both during the risk game and the time between games. To entice players visually, the risk-display column is advisably switched as an animated device between games, that is, the display elements of the risk-display column are illuminated in a predetermined or random manner.

In an alternative embodiment of the entertainment machine, the risk game device is preferably accommodated in a wall housing. A plurality of risk game devices is usefully disposed in the wall housing. To give special emphasis to the attainable wins, according to a further embodiment, the display elements of the risk game device are respectively subdivided into a display region representing a win and a display region that flashes during a risk game. Furthermore, the entertainment machine is usefully provided with a coin-deposit slot, a bill-return slot and/or a user card-insertion slot. In this way, the entertainment machine can be operated using different methods of payment.

To further increase the entertainment value for the player, in accordance with a modification of the invention, at least one additional-win game device, in which a win attained in the risk game device can be played out, is associated with the risk game device. This offers the player the option of increasing the win he has attained in the risk game device, at the risk of decreasing it. The additional-win game device is preferably configured in the manner of a roulette game, with a roulette wheel comprising display fields, on which a spinning ball can be represented as a point of light. As an alternative, the additional-win game device is preferably a symbol game device whose rotating bodies, which are provided with symbols, display a game result behind viewing windows after they have stopped. To further increase the appeal of the game, at least one of the rotating bodies of the symbol game device and/or a separate rotating body is provided with at least one conduit, which extends outwardly from its axis of rotation and can be seen into, for accepting coins that can be paid out via a payout device upon the occurrence of a certain event in the risk game device and/or the additional-win game device. The player can therefore immediately recognize the amount of coins he actually receives in the event of a win and, moreover, the player can estimate the total value the coins represent based on his recognition of the fullness of the rotating body with coins.

In a further alternative embodiment of the entertainment machine, at least one jackpot game arrangement is associated with the risk game device for attaining an additional win. The jackpot game arrangement comprises a light strip encompassing different win-display elements. When a certain event occurs in the risk game device and/or in the additional-win game device, a specific win-display element of the light strip provided with a symbol relating to the attained win is illuminated. When a certain number of win-display elements of the light strip is illuminated, the additional win is attained. The light strip of the jackpot game arrangement can, however, also comprise neutral display elements that can be illuminated in order upon the occurrence of a certain event in the risk game device and/or the additional-win game device, and effect the additional win when the light strip is completely illuminated.

Of course, the features described above and below can be used not only in the disclosed combination, but also in other combinations or by themselves, within the scope of the present invention.

BRIEF DESCRIPTION OF THE DRAWINGS

The concept underlying the invention is described in detail in the following description by way of two embodiments that are illustrated in the drawings in which.

DETAILED DESCRIPTION OF THE PREFERRED EMBODIMENTS

Figure 1:
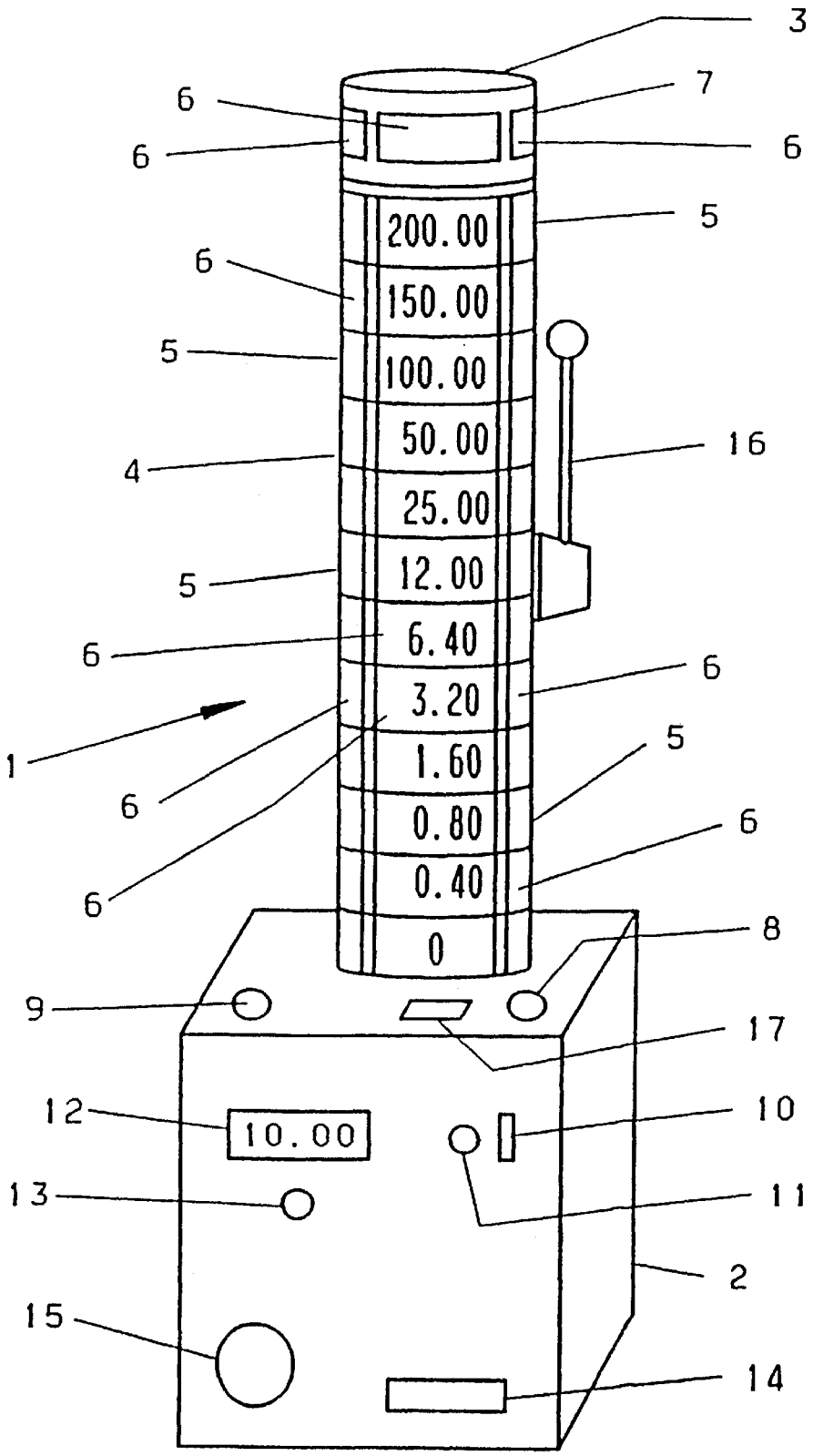
FIG. 1 is a frontal view in perspective of an entertainment machine of the invention.

The entertainment machine, being provided with a computer-controlled control unit for the entire course of the game, has a risk game device 1, which increases a stake with the risk of loss, and is accommodated in a circular risk-display column 3 supported on a parallelepiped stand housing 2. The computer determines the entire course of the game, including the announcement and the payout of a win. The control and calculating functions are performed corresponding to the programs of the computer, which can be adapted to all functions. The risk-display column 3 comprises a plurality of display elements 5 arranged one on top of the other to form a display scale 4 that can be illuminated. The lowermost display element 5 represents a total loss (character "0"), while the display elements above it represent monetary wins in ascending order. Each display element 5 is subdivided over its circumference into three identical display segments 6, which represent the same win values. At the upper end of the risk-display column 3 is a circular display field 7, which is likewise subdivided at its circumference into three identical display segments 6. The win of the respective level that has been attained in the risk game device 1 is additionally represented in the display field 7 or associated display segments 6 inside the risk-display column 3. A manual start lever 16 for starting the game is attached laterally to the risk-display column 3.

A risk key 8 and a payoff key 9, which are associated with the risk game device 1, are disposed on the top side of the stand housing 2. A coin-deposit slot 10 of a coin-processing device, a coin-return key 11, a credit display 12 for the status of the coin credit and a key 13 for step-wise selection of the magnitude of the stake in the risk-display column 3 are disposed in the upper region of the front side of the stand housing 2. A coin-payout dish 14 and a loudspeaker 15 are provided in the lower region of the stand housing 2.

The game proceeds in the entertainment machine as follows. After the required coins have been deposited into the coin-deposit slot 10, the corresponding monetary amount is represented by the credit display 12. Through corresponding actuation of the key 13, the magnitude of the monetary amount is then selected, with the display elements 6 that represent increasing monetary wins illuminating upwardly in steps corresponding to the frequency of key 13 actuation. The display element 5 marking the selected monetary amount remains illuminated; for example, this may be the display element 5 representing DM 1.60. After the manual start lever 16 is actuated, this amount is risked. The amount additionally represented in the display field 7 can be risked in that the next-higher display element 5 representing DM 3.20 flashes, with respect to the illuminated display element 5 representing the monetary amount of DM 1.60, alternatingly with the display element 5 disposed at the lower end of the display scale 4 and representing a total loss, having the character "0." When the risk key 8 is actuated, or after a specific period of time has elapsed, either the next-higher win (DM 3.20) is attained, in which case the display element 5 representing DM 3.20 remains illuminated and this amount is simultaneously represented in the display field 7, or the monetary amount is lost. In the event of a win, which then represents the stake, this process can be continued until the highest win is attained. A win or partial win attained in this manner can be collected at any time through appropriate actuation of the payoff key 9, with the corresponding amount being added in the credit display 12. The amount represented the credit display 12 can be deposited into in the coin-payout dish 14 through actuation of the coin-return key 11. During the risk game, acoustic information, for example about the game status, or background music can be provided by way of the loudspeaker 15.

A possible alternative is to provide a fixed monetary amount, for example DM 1, with the wins that are represented on the display scale 4 being fixed and increasing, for example, above the monetary amount level of DM 1 in the sequence of DM 2, DM 4, DM 8, etc. It is further possible to make the monetary amount variable, for example in a range of DM 0.10 to DM 2, appropriately changing the win representation by the display elements 5 of the display scale 4 corresponding to the selected amount. The risk game is always entered at the lowest level of the display scale 4. It is also possible, however, to establish the entrance through playing out with computer control.

The entertainment machine is further equipped with an automatic risk device that can be switched on and off with the risk key 8. When the automatic device is switched on, a display field 17 associated with the risk key 8 is illuminated, and amounts are automatically risked until either a certain monetary amount is attained or the loss of the stake is indicated by the illumination of the display element 5 representing a total loss. If the credit is less than a stake, the automatic risk device is switched off.

Figure 2:
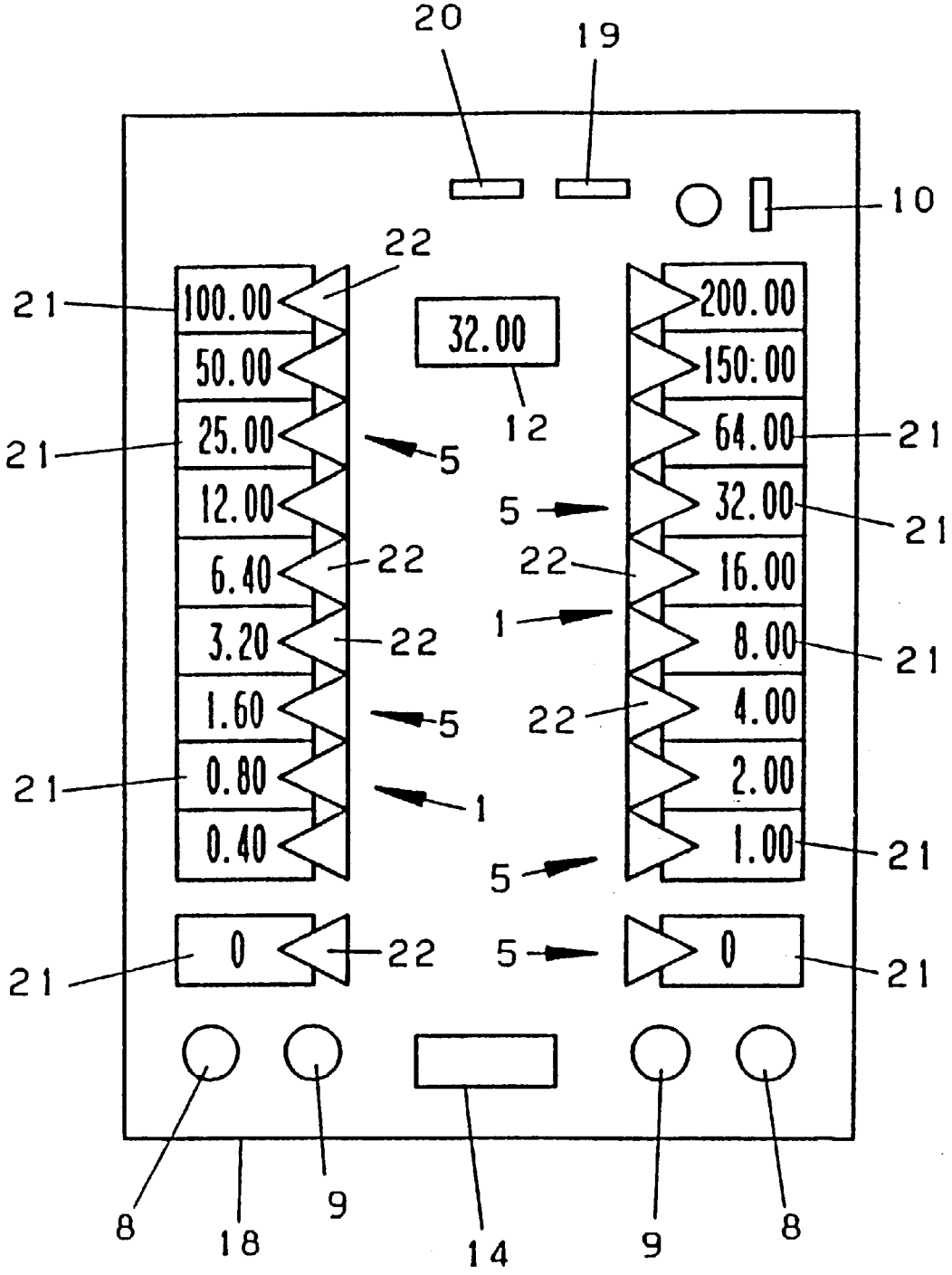
FIG. 2 is an alternative embodiment of the entertainment machine.

In the embodiment of the entertainment machine illustrated in FIG. 2, two risk game devices 1 are integrated into a wall housing 18 provided with, in addition to the coin-deposit slot 10, a bill-insertion slot 19 and a user card-insertion slot 20, which are associated with a money-processing device. The display elements 5 of the risk game devices 1 are respectively subdivided into a display region 21 representing a win and a display region 22 that flashes during a risk game.

I claim:

1. A money-operated entertainment machine having a game device comprising a plurality of display elements displaying individual magnitudes of monetary amounts corresponding directly to a deposit of money, or a portion or multiple thereof, said magnitudes of monetary amounts representing individual wins, which can be illuminated, and having a computer-controlled control unit for controlling the course of the game, wherein the game device is a risk game device that enables a player to directly increase a monetary amount determined by the deposit of money which directly selects a magnitude of monetary amount, or a portion or multiple thereof, when a risk of loss exists.

2. The entertainment machine according to claim 1, wherein the risk game device includes a risk-display column supported on a stand housing, said risk-display column having a display scale which comprises a plurality of display elements arranged one on top of the other.

3. The entertainment machine according to claim 2, wherein each display element of the risk-display column is subdivided into at least two display segments that represent the same win value and are spatially offset from one another.

4. The entertainment machine according to claim 2, wherein the risk-display column is circular or polygonal.

5. The entertainment machine according to claim 2, wherein the lowermost display element of the risk-display column represents a total loss, and the display elements above it represent wins in ascending order.

6. The entertainment machine according to claim 2, further comprising a display field at the upper end of the risk-display column, in which field the attained win of the respective level can be additionally represented inside the risk-display column.

7. The entertainment machine according to claim 6, wherein the display field is subdivided into at least two display segments representing the same win value and offset from one another.

8. The entertainment machine according to claim 2, wherein the display elements of the risk-display column are configured as displays capable of representing different values.

9. The entertainment machine according to claim 2, further comprising a key for step-wise selection of the magnitude of the monetary amount in the risk-display column, the monetary amount corresponding with the credit display.

10. The entertainment machine according to claim 2, further comprising a risk key which is associated with the risk-display column, and wherein either a higher win is attained, or the deposited monetary amount or the win is lost when this key is actuated.

11. The entertainment machine according to claim 2, further comprising a payoff key which is associated with the risk-display column, and wherein the risk game is terminated and an attained win is paid out when this key is actuated.

12. The entertainment machine according to claim 2, further comprising at least one loudspeaker, said at least one loudspeaker being disposed inside the stand housing.

13. The entertainment machine according to claim 2, wherein the risk-display column is switched as an animated device during the time between games.

14. The entertainment machine according to claim 2, wherein the display elements of the risk game device are respectively subdivided into a display region representing a win.

15. The entertainment machine according to claim 1, further comprising a manual start lever and wherein the game is initiated by the actuation of the manual start lever when a sufficient monetary amount is represented in a credit display.

16. The entertainment machine according to claim 1, wherein the risk game device is disposed in a wall housing.

17. The entertainment machine according to claim 16, further comprising a plurality of risk game devices disposed in the wall housing.

18. The entertainment machine according to claim 1, further comprising a coin-deposit slot, a bill-insertion slot and/or a user card-insertion slot.

19. A money-operated entertainment machine comprising:

a risk game device including a plurality of display elements displaying individual magnitudes of monetary amounts corresponding directly to a deposit of money, or a portion or multiple thereof, said magnitudes of monetary amounts represent individual wins and can be illuminated;

a computer-controlled control unit for controlling the course of the game;

means for depositing a monetary amount which actuates the risk game; and means for selecting the magnitude of the monetary amount, said selected monetary amount being the deposited monetary amount, a portion or a multiple thereof, wherein the risk game device is directly actuated by the deposit of money and a player can increase the monetary amount when a risk of loss exists.

* * * * *